US007598500B2

(12) United States Patent
Murphy et al.

(10) Patent No.: US 7,598,500 B2
(45) **Date of Patent: *Oct. 6, 2009**

(54) ION SOURCE AND METALS USED IN MAKING COMPONENTS THEREOF AND METHOD OF MAKING SAME

(75) Inventors: Nestor P. Murphy, West Bloomfield, MI (US); David E. Rock, Sylvania, OH (US); Hugh A. Walton, Holly, MI (US); Maximo Frati, Ypsilanti, MI (US)

(73) Assignee: Guardian Industries Corp., Auburn Hills, MI (US)

( * ) Notice: Subject to any disclaimer, the term of this patent is extended or adjusted under 35 U.S.C. 154(b) by 258 days.

This patent is subject to a terminal disclaimer.

(21) Appl. No.: 11/523,089

(22) Filed: Sep. 19, 2006

(65) Prior Publication Data

US 2008/0067400 A1 Mar. 20, 2008

(51) Int. Cl.
*H01J 27/14* (2006.01)

(52) U.S. Cl. ..... 250/426; 250/423 R; 250/424; 315/111.21; 315/111.31; 315/111.41; 315/111.81; 315/111.91; 313/153; 313/162; 313/306; 313/307; 313/311

(58) Field of Classification Search ..... 250/423 R, 250/424; 315/111.21, 111.31, 111.41, 111.81, 315/111.91; 118/723 FI, 723 CB, 723 EB; 313/153, 162, 306, 307, 311, 359.1, 361.1, 313/362.1

See application file for complete search history.

(56) References Cited

U.S. PATENT DOCUMENTS 4,943,485 A * 7/1990 Allam et al. ..... 428/457
6,002,208 A * 12/1999 Maishev et al. ..... 315/111.91
6,242,749 B1 * 6/2001 Maishev et al. ..... 250/423 R
6,259,102 B1 * 7/2001 Shun'ko ..... 250/423 R
6,359,388 B1 3/2002 Petrmichl
6,676,134 B1 1/2004 Wiegert et al.
6,815,690 B2 * 11/2004 Veerasamy et al. ..... 250/423 R
6,987,364 B2 * 1/2006 Petrmichl ..... 315/111.81
6,988,463 B2 * 1/2006 Veerasamy et al. ..... 118/723 FI
7,030,390 B2 * 4/2006 Veerasamy et al. ..... 250/423 R
7,405,411 B2 * 7/2008 Walton, Hugh A. ..... 250/423 R
2004/0075060 A1 * 4/2004 Luten et al. ..... 250/423 R
2005/0057167 A1 * 3/2005 Siegfried et al. ..... 315/111.81

OTHER PUBLICATIONS

Definition of Annealing [online]. Dictionary.com 2008 [retrieved on May 1, 2008].

* cited by examiner

*Primary Examiner*—David A Vanore
*Assistant Examiner*—Michael Maskell
(74) *Attorney, Agent, or Firm*—Nixon & Vanderhye P.C.

(57) ABSTRACT

An ion source is capable of generating and/or emitting an ion beam which may be used to deposit a layer on a substrate or to perform other functions. In certain example embodiments, techniques for reducing the costs associated with producing ion sources and/or elements thereof are provided. Such techniques may include, for example, forming the inner and/or outer cathode(s) from 1018 mild steel and/or segmented pieces. Such techniques also or instead include, for example, forming the ion source body from a single steel U-channel, or from segmented pieces making up the same. These techniques may be used alone or in various combinations.

11 Claims, 4 Drawing Sheets

ION SOURCE AND METALS USED IN MAKING COMPONENTS THEREOF AND METHOD OF MAKING SAME

FIELD OF THE INVENTION

The example embodiments herein relate to an ion source for generating an ion beam (diffuse, focused, or collimated beam). In certain example embodiments, techniques for reducing the costs associated with producing ion sources and/or elements/components thereof are provided. Such techniques may include, for example, forming the inner and/or outer cathode from 1018 mild steel and/or segmented pieces. Such techniques also may include forming the ion source body from a single standard construction steel U-channel, or from segmented pieces. These techniques may be used alone or in various combinations.

BACKGROUND AND SUMMARY OF EXAMPLE EMBODIMENTS OF THE INVENTION

An ion source is a device that causes gas molecules to be ionized and then accelerates and emits the ionized gas molecules and/or atoms in a beam (ion beam) toward a substrate. Such an ion beam may be used for various purposes, including but not limited to cleaning a substrate, activation, polishing, etching, and/or deposition of thin-film coatings/layer(s). Example ion sources are disclosed, for example, in U.S. Pat. Nos. 7,030,390; 6,988,463; 6,987,364; 6,815,690; 6,812,648; 6,359,388; and application Ser. No. 10/986,456, the disclosures of which are all hereby incorporated herein by reference.

FIGS. 1-2 illustrate a conventional cold-cathode type ion source. In particular, FIG. 1 is a side cross-sectional view of an ion beam source with an ion beam emitting slit defined in the cathode, and FIG. 2 is a corresponding sectional plan view along section line II-II of FIG. 1. FIG. 3 is a sectional plan view similar to FIG. 2, for purposes of illustrating that the FIG. 1 ion beam source may have an oval and/or racetrack-shaped ion beam emitting slit as opposed to a circular ion beam emitting slit. Any other suitable shape also may be used.

Referring to FIGS. 1-3, the ion source includes a hollow housing made of a magneto conductive material, which is used as a cathode 5. Cathode 5 includes cylindrical or oval side wall 7, a closed or partially closed bottom wall 9, and an approximately flat top wall 11 in which a circular or oval ion emitting slit and/or aperture (also sometimes referred to as a "discharge gap") 15 is defined. The bottom wall 9 and side walls 7 of the cathode 5 are optional. The outer cathode is typically made of 1008 steel at a substantial cost. Ion emitting slit/aperture 15 includes an inner periphery as well as an outer periphery. Deposit and/or maintenance gas supply aperture or hole(s) 21 is/are formed in bottom wall 9. Flat top wall 11 functions as an accelerating electrode. A magnetic system including a cylindrical permanent magnet 23 with poles N and S of opposite polarity is placed inside the housing between bottom wall 9 and top wall 11. The N-pole faces flat top wall 11, while the S-pole faces bottom wall 9. The purpose of the magnetic system with a closed magnetic circuit formed by the magnet 23 and cathode 5 is to induce a substantially transverse magnetic field (MF) in an area proximate to ion emitting slit 15.

The ion source may be entirely or partially within conductive wall 50, and/or wall 50 may at least partially define the deposition chamber. In certain instances, wall 50 may entirely surround the source and substrate 45, while in other instances the wall 50 may only partially surround the ion source and/or substrate.

A circular or oval shaped conductive anode 25, electrically connected to the positive pole of electric power source 29, is arranged so as to at least partially surround magnet 23 and be approximately concentric therewith. Anode 25 may be fixed inside the housing by way of insulative ring 31 (e.g., of ceramic). Anode 25 defines a central opening therein in which magnet 23 is located. The negative pole of electric power source 29 may be grounded and connected to cathode 5, so that the cathode is negative with respect to the anode. Generally speaking, the anode 25 is generally biased positive by several thousand volts. Meanwhile, the cathode (the term "cathode" as used herein includes the inner and/or outer portions thereof) is generally held at ground potential although it need not be. This is the case during aspects of source operation, including during a mode in which the source is being cleaned.

The conventional ion beam source of FIGS. 1-3 is intended for the formation of a unilaterally directed approximately tubular ion beam, flowing in the direction toward substrate 45. Substrate 45 may or may not be biased in different instances. The ion beam emitted from the area of slit/aperture 15 is in the form of a circle in the FIG. 2 embodiment and in the form of an oval (e.g., race-track) in the FIG. 3 embodiment.

The ion source of FIGS. 1-3 operates as follows in a depositing mode when it is desired that the ion beam from the source deposit at least one layer on substrate 45. A vacuum chamber in which the substrate 45 and slit/aperture 15 are located is evacuated, and a depositing gas (e.g., a hydrocarbon gas such as acetylene, or the like) is fed into the interior of the source via aperture(s) 21 or in any other suitable manner. A maintenance gas (e.g., argon) may also be fed into the source in certain instances, along with the depositing gas. Power supply 29 is activated and an electric field is generated between anode 25 and cathode 5, which accelerates electrons to high energy. Anode 25 is positively biased by several thousand volts, and cathode 5 may be at ground potential as shown in FIG. 1. Electron collisions with the gas in, and/or proximate to, aperture/slit 15 leads to ionization and a plasma is generated. "Plasma" herein means a cloud of gas including ions of a material to be accelerated toward substrate 45. The plasma expands and fills (or at least partially fills) a region including slit/aperture 15. An electric field is produced in slit 15, oriented in the direction substantially perpendicular to the transverse magnetic field, which causes the ions to propagate toward substrate 45. Electrons in the ion acceleration space in and/or proximate to slit/aperture 15 are propelled by the known E×B drift in a closed loop path within the region of crossed electric and magnetic field lines proximate to slit/aperture 15. These circulating electrons contribute to ionization of the gas (the term "gas" as used herein means at least one gas), so that the zone of ionizing collisions extends beyond the electrical gap between the anode and cathode and includes the region proximate to slit/aperture 15 on one and/or both sides of the cathode 5. For purposes of example, consider the situation where a silane and/or acetylene ($C_2H_2$) depositing gas is/are utilized by the ion source of FIGS. 1-3 in a depositing mode. The silane and/or acetylene depositing gas passes through the gap between anode 25 and cathode 5.

Reference will be made below to various steels conforming to the corresponding standards of the American Iron and Steel Institute (AISI), as will be appreciated by one of ordinary skill in the art.

Unfortunately, the ion source of FIGS. 1-3 suffers several drawbacks. In conventional ion sources, the outer cathode is manufactured from a single piece of 1008 mild steel. Manufacturing the outer cathode from 1008 mild steel is a costly endeavor. One reason the cost of 1008 steel is high is because 1008 mild steel itself is not readily available. Costs also are high because of the machining requirements associated with producing the outer cathode from such steel. More particularly, the costs of forming the outer cathode are high because the outer cathode has a complex design. Thus, a large piece of 1008 mild steel is required, even though a significant portion of it is sacrificed while machining the steel, to achieve the complex design. Furthermore, 1008 steel generally is difficult to machine, thus requiring higher labor and/or machining costs.

Furthermore, the body of conventional ion sources typically are manufactured from a single piece of mild steel. Manufacturing costs are high. This is because the complexity of the design of the ion source body similarly requires a significant amount of machining, and a large amount of material is lost in the machining process because the ion source body is machined from a large, solid piece of steel.

Thus, it will be appreciated that there exists a need in the art for an ion source that overcomes one or more of the above problems and/or other disadvantages.

Certain example embodiments of this invention provide a cathode for use in an ion source, wherein at least part of the cathode is formed from annealed 1018 mild steel. The cathode made from such 1018 mild steel maybe an inner cathode and/or an outer cathode.

Certain other example embodiments of this invention provide an ion source capable of emitting an ion beam. Such example embodiments may comprise an anode, an inner cathode, and an outer cathode, with one of the anode, the inner cathode, and the outer cathode having a discharge gap defined therein. A power supply may be in electrical communication with the anode, the inner cathode, and/or the outer cathode. At least one magnet may be capable of generating a magnetic field proximate to the discharge gap. The inner cathode and/or the outer cathode may be formed from annealed 1018 mild steel.

According to certain other example embodiments of this invention, a segmented cathode for use with an ion source is provided. Such example embodiments may comprise, for the segmented cathode, a substantially rectangular top portion; a substantially rectangular bottom portion; a substantially U-shaped left-side portion; and, a substantially U-shaped right-side portion. Optionally, a first set of notches disposed at each end of the top portion and bottom portion may be configured to engage with a second set of notches disposed at each end of the left-side portion and right-side portion. In certain example non-limiting embodiments, each of the top, bottom, left-side, and right-side portions may be machined to eliminate at least some of the material thereof. In certain non-limiting example embodiments, the segmented cathode may further comprise at least one hole, with one or more such hole(s) being configured to receive a bolt or the like, and with each bolt or the like being provided to attach the segmented cathode to an outer housing of the ion source. The segmented cathode may be an outer cathode in certain example instances.

In certain example embodiments of this invention, there is provided an ion source comprising: an anode, an inner cathode and an outer cathode, a discharge gap defined between the inner and outer cathodes; a power supply in electrical communication with one or more of the anode, the inner cathode, and/or the outer cathode; at least one magnet capable of generating a magnetic field proximate to the discharge gap; and wherein the inner cathode and/or the outer cathode comprises annealed 1018 mild steel.

In other example embodiments of this invention, there is provided a an ion source comprising an anode, a cathode, a discharge gap defined proximate the anode and cathode; a power supply in electrical communication with the anode and/or cathode; at least one magnet capable of generating a magnetic field proximate the discharge gap; and wherein the anode and/or cathode comprises 1018 mild steel.

In still further example embodiments of this invention, there is provided a method of making an ion source, the method comprising: providing an anode, providing a plurality of pieces comprising steel for an outer cathode, and attaching the plurality of pieces comprising steel together to form the outer cathode; providing an inner cathode; assembling the anode, inner cathode and outer cathode in an ion source apparatus so as to form a discharge gap of the ion source defined between the inner and outer cathodes.

In yet other example embodiments of this invention, there is provided a method of making an ion source, the method comprising: providing an anode, providing a steel U-channel; processing the U-channel to form at least an outer cathode for the ion source; assembling the anode, an inner cathode and the outer cathode formed using the U-channel in an ion source apparatus so as to form a discharge gap of the ion source defined between the inner and outer cathodes.

BRIEF DESCRIPTION OF THE DRAWINGS

These and other features and advantages will be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
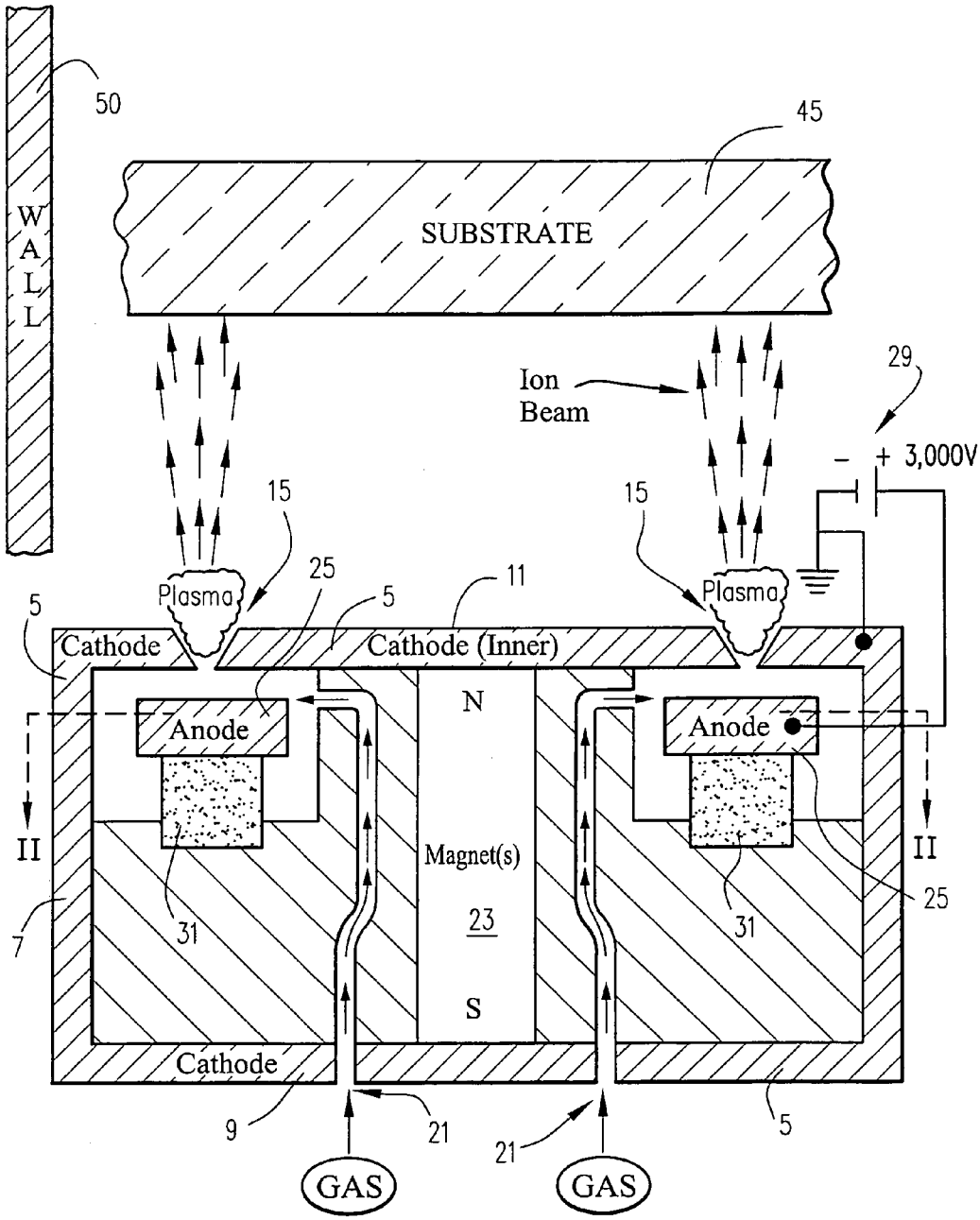
FIG. 1 (PRIOR ART)
FIG. 1 is a schematic partial cross-sectional view of a conventional ion source.

In the following descriptions, example embodiments will be described as relating to different types of steels and/or segmented designs for both the inner and/or outer cathode, and/or the ion source body. However, it will be appreciated that the example embodiments herein relate to various combinations thereof, and that the present invention is not limited to any specific combination. Thus, according to certain example embodiments, the type of steel for the inner and/or outer cathode may be chosen independent of the design of the inner and/or outer cathode. Similarly, according to certain example embodiments, the type of steel for the ion source may be chosen independent of the design of the ion source.

Finally, the type of steel for and design of the inner and/or outer cathode may be chosen independent of the type of steel for and design of the ion source body. Different inventions herein may or may not be used in combination with each other. The ion source may be of the cold cathode closed-drift type in certain example embodiments of this invention.

Referring now more particularly to the accompanying drawings in which like reference numerals indicate like parts throughout the several views.

1. Example Embodiments Relating to the Inner and/or Outer Cathode

1.1 Choice of Metal

It will be appreciated that the example embodiments described below may relate to the use of steel and/or annealing of either the inner cathode, the outer cathode, or both.

Figure 2:
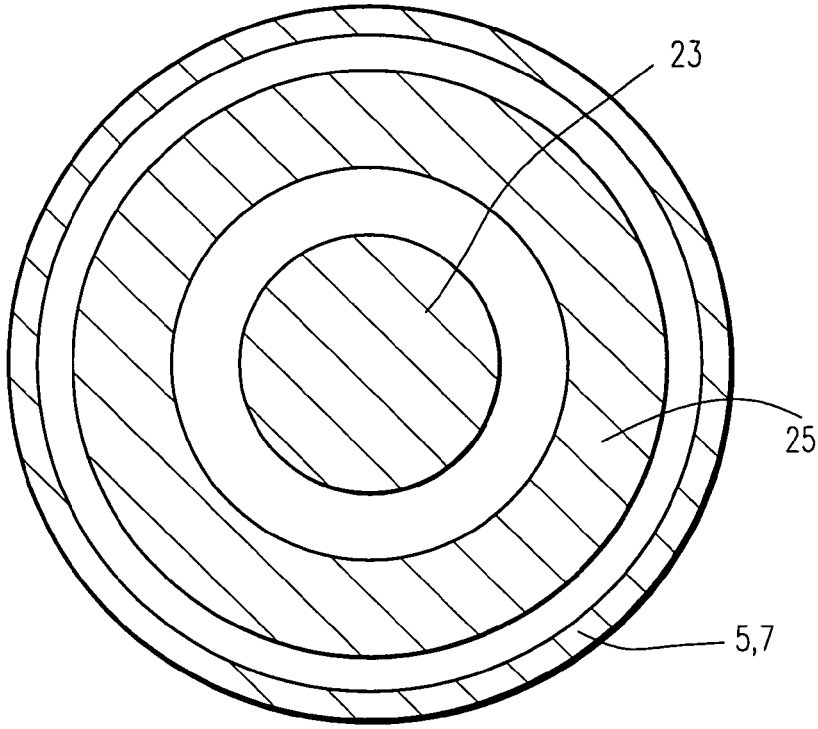
FIG. 2 (PRIOR ART)
FIG. 2 is a sectional view taken along section line II-II of FIG. 1.
Figure 3:
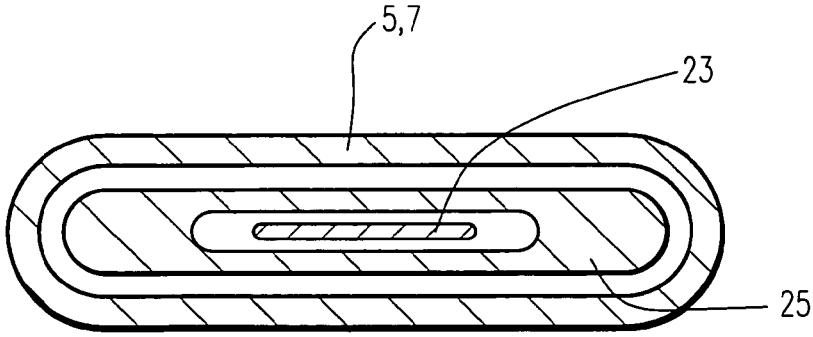
FIG. 3 (PRIOR ART)
FIG. 3 is a sectional view similar to FIG. 2, taken along section line II-II in FIG. 1, in another embodiment illustrating that the ion source may be shaped in an oval manner instead of in a circular manner.

As noted above, 1008 mild steel conventionally has been used for inner and/or outer cathodes (e.g., see the cathode at reference numerals 5, 7 and 11 in FIGS. 1-3). This is because 1008 steel generally has advantageous magnetic properties. In particular, one reason 1008 steel has been preferred relates to the lower percentage of carbon—specifically, as specified by the AISI, 1008 steel has only about 0.1% carbon (whereas 1018 steel has about 0.14-0.2% carbon). Yet, as noted above, 1008 steel is hard to machine and generally is more expensive because it is less readily available. Thus, it would be advantageous to provide an inner and/or outer cathode in an ion source that has substantially similar magnetic properties to, but is less costly and easier to machine than, an inner and/or outer cathode formed from 1008 steel.

It has been determined that annealed 1018 mild steel (e.g. AISI standard hot-rolled 1018 steel) is surprisingly advantageous compared to 1008 mild steel, when used to form the inner and/or outer cathode 5, 7 and/or 11 of an ion source. 1018 grade steel has been found to be easier to machine than 1008 steel. Using 1018 mild steel may also reduce the costs associated with manufacturing inner and/or outer cathodes for ion sources because of the availability of 1018 steel. Additionally, the annealing process may make the steel yet more malleable and ductile, thus making it easier to machine and potentially reducing the machining-related costs in making ion sources.

The annealing process also may reduce defects in the lattice structure of the steel. Thus, the 1018 steel may perform similar to 1008 mild steel with respect to its magnetic properties. For example, after the 1018 steel is annealed, the associated Brinell hardness (500 HBW) may drop from about 143 HB to about 85 HB, thus making it more malleable and ductile. However, it will be appreciated that as the 1018 steel is annealed, the associated Brinell hardness (500 HBW) may drop from about 110-150 HB to about 80-105 HB, thus making it more malleable and ductile. Defects in the lattice structure also may be reduced. Moreover, after machining, it is possible that the 1018 could be rehardened by water quenching and/or brine quenching, or the like. Also, the magnetic flux density (B) vs. magnetic field strength (H) hysteresis loops for the 1008 steel and annealed 1018 steel may compare fairly well with each other. Annealing is preferred in certain example non-limiting instances, as the B vs. H hysteresis loops for 1008 steel and non-annealed 1018 compare fairly well with each other. A full anneal may be achieved in certain example instances, for example, by soaking the 1018 steel at about 890° C., followed by furnace cooling.

It will be appreciated that the substitution of steels and/or annealing has very slight, if any, effect on the electrical properties of the inner and/or outer cathode(s) of the ion source. It will be appreciated that such techniques may also or instead be used for an anode 25, in addition to or apart from changes to the inner and/or outer cathode. Additionally, where the cathode 5, 7, 11 and anode 25 are reversed, the techniques similarly may apply to inner and/or outer anodes.

1.2 Segmented Design

As noted above, machining the outer cathode may be difficult and costly because of, for example, its complexity, the high cost of the materials, etc. However, it has been determined that a segmented design for the outer cathode 5, 7 may reduce the costs and difficulties associated with constructing an outer cathode. Costs may be reduced yet further by using a mild steel (e.g. 1018 steel) with a segmented design in certain optional instances.

An example segmented design using four pieces will now be described with reference to FIGS. 4-7. Although, certain example embodiments are described as having four pieces, the invention is not so limited. For example, more or fewer pieces may be used for the outer cathode according to the techniques set forth herein. However, it has been determined that forming an outer cathode from four pieces is advantageous because such example embodiments are easy to machine and assemble at reduced costs.

Figure 4:
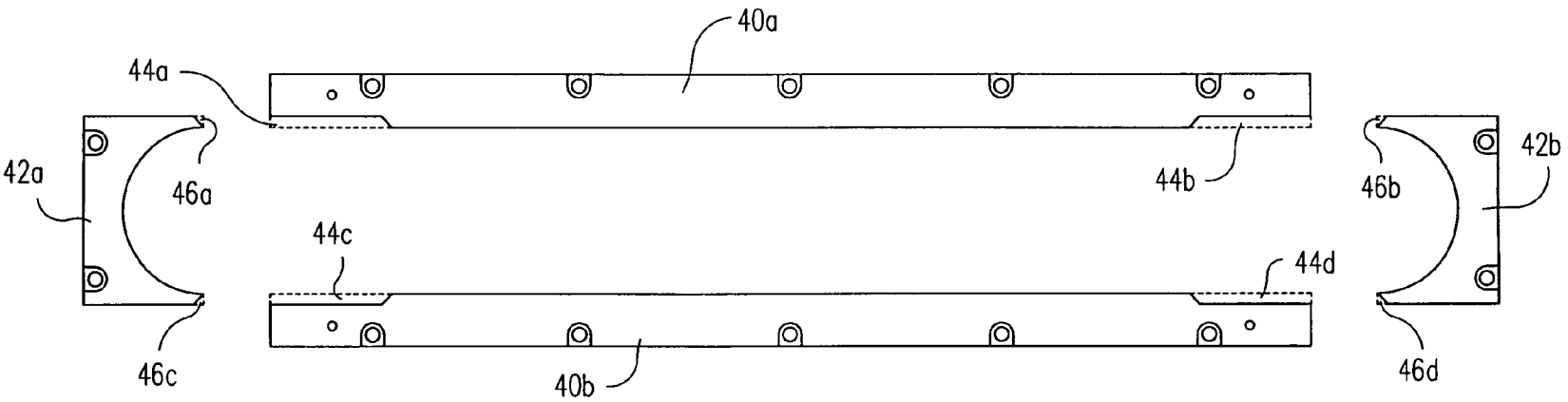
FIG. 4 is an exploded top view of sample pieces from which the outer cathode may be machined in accordance with an example embodiment of this invention.

FIG. 4 is an exploded view of sample pieces from which the outer cathode 5 may be machined in accordance with an example embodiment of this invention. FIG. 4 shows top and bottom pieces 40*a-b* and left and right pieces 42*a-b* (as viewed from above for example). Top and bottom pieces 40*a-b* at least initially are substantially rectangular shaped, and left and right pieces 42*a-b* at least initially are substantially U-shaped. However, it will be appreciated that other shapes may instead be used. For example, left and right pieces 42*a-b* may be substantially square shaped or tapered in shape, and/or the center portions may be removed to produce substantially concave left and/or right pieces. Care may be taken when selecting the pieces from which the segments of the outer cathode are to be formed, so as to reduce the amount of wasted material. Also, it will be appreciated that other shapes of the pieces may be used based on the ultimate shape of outer cathode desired (e.g. differently sized and/or shaped pieces may be used for substantially circular outer cathodes).

Figure 5:
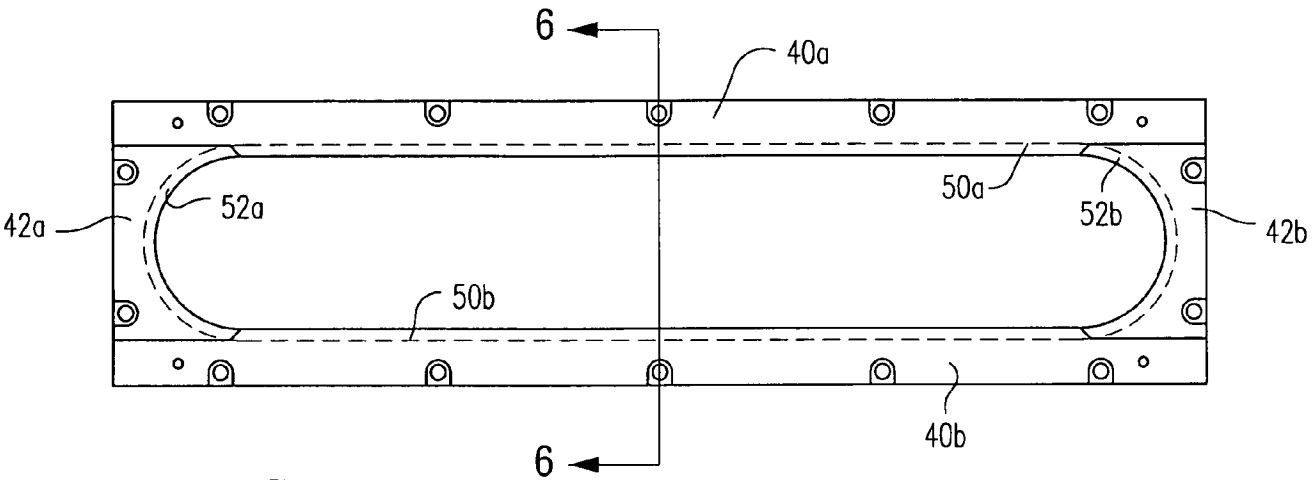
FIG. 5 is a top view of the sample pieces from FIG. 4 having been assembled in accordance with an example embodiment of this invention.

Top and bottom pieces 40*a-b* and left and right pieces 42*a-b* (again, top, bottom, left and right are used as viewed from above as in FIGS. 4-5) may have complementary notches to facilitate the connections therebetween in certain example embodiments of this invention. For example, top piece 40*a* may have slanting notches 44*a-b*, to engage with slanting notches 46*a-b* on left and right pieces 42*a-b*, respectively. Similarly, bottom piece 40*b* may have slanting notches 44*c-d*, to engage with slanting notches 46*c-d* on left and right pieces 42*a-b*, respectively. It will be appreciated that the sizes and shapes of the notches are shown by way of example and without limitation. For example, in other example embodiments of this invention, facilitation of the connection between the pieces may instead be made with, for example, tongue-and-groove type connections, o-ring connections, adhesives, or the like.

FIG. 5 is a top view of the sample pieces from FIG. 4 having been assembled in accordance with an example embodiment of this invention. The dashed line in FIG. 5 indicates the portion of the assembly from which the outer cathode 5 ultimately will be formed. In particular, the assembled outer cathode will comprise four pieces according to this example embodiment—namely, top and bottom pieces 50*a-b*, and left and right pieces 52*a-b*. The assembly will be substantially racetrack shaped according to this example embodiment, though the invention is not so limited.

Figure 6:
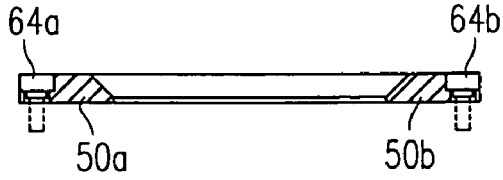
FIG. 6 is a sectional view taken along the section line 6-6 of FIG. 5; and, FIG. 7 is a view of a sample segmented outer cathode in accordance with an example embodiment of this invention.

FIG. 6 is a side cross-sectional view taken along the section line 6-6 of FIG. 5. The top and bottom portions 50*a-b* are shown in FIG. 6 as slanting inward. However, it will be appreciated that this particular feature of the cathode is provided by way of example and without limitation.

Figure 7:
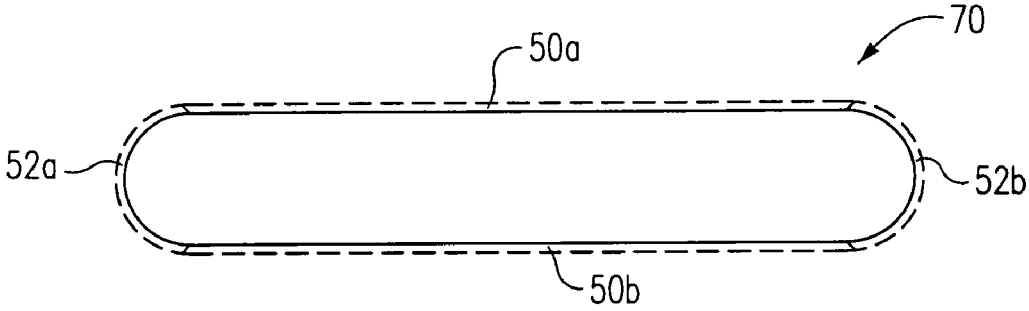

FIG. 7 is a view of a sample segmented outer cathode 70 in accordance with an example embodiment, shown as comprising top and bottom pieces 50*a-b*, and left and right pieces 52*a-b*. The pieces may be bolted to the outer housing (e.g. using bolts 64*a-b* as shown in FIG. 6, or any other suitable structure) and may thereby come together to form the substantially racetrack-shaped outer cathode. According to certain example embodiments, the pieces will come together with a tolerance of about less than about 0.001" clearance. It will be appreciated that if the gap between the pieces is too large, then the electrical field will be adversely affected (e.g. it may break down).

It will be appreciated that the pieces may be held together in other ways apart from, or in addition to, the bolts. For example, the pieces may be adhered to one another and/or to the outer housing using an adhesive.

It will be appreciated that such techniques may be used for an anode 25, in addition to or apart from changes to the outer cathode. Additionally, where the cathode and anode are reversed, the techniques similarly may apply to the outer anode.

2. Example Embodiments Related to Ion Source Bodies

2.1 Standard U-Channel Steel

An ion source body may be manufactured using a rectified piece of a standard construction steel U-channel in certain example embodiments of this invention (instead of a standard block-shaped cast of steel). Manufacturing the source body from a standard construction steel U-channel may substantially reduce machining costs due to less material being wasted and easier machining processes, thereby resulting in an overall cost reduction. In certain example embodiments, stock U-channels may be used. However, it will be appreciated that some machining may be necessary, such as crimping or bending the ends of the Us to form the inwardly protruding portions of the outer cathode 5. Thus, ion source bodies may be produced without having to (or with a reduced need to) machine a solid piece of steel.

2.2 Standard U-Channel Steel with Segmented Design

Certain example embodiments reduce the manufacturing cost of the ion source by replacing the one piece construction body of the ion source with an arrangement of several (e.g., three) plates, thereby forming a U-channel after assembly of the multiple pieces. More simple pieces may be used as compared to a solid piece of steel, and the amount of material wasted also may be reduced. The several steel plates may be attached together, for example, using hardware screws, welds, and/or o-ring seals. In those example embodiments where the several plates are attached together in whole or in part with o-ring seals, it may be necessary to machine the plates to provide o-ring grooves for engaging with the o-rings, thus forming the seal. In those embodiments where hardware screws are used, the screws need not have any special magnetic and/or electrical properties.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An ion source comprising:

an anode, an inner cathode and an outer cathode, a discharge gap defined between the inner and outer cathodes;

a power supply in electrical communication with one or more of the anode, the inner cathode, and/or the outer cathode;

at least one magnet capable of generating a magnetic field proximate to the discharge gap; and wherein the inner cathode and/or the outer cathode comprises annealed 1018 mild steel, wherein the outer cathode comprises first, second, third and fourth conductive pieces, and wherein an interface between the second and third conductive pieces is angled relative to an immediately adjacent edge of the discharge gap, and an interface between the first and fourth conductive pieces is angled relative to an immediately adjacent edge of the discharge gap.

2. The ion source of claim 1, wherein the 1018 mild steel is soaked at high temperature and cooled so as to be annealed.

3. The ion source of claim 1, wherein at least the inner cathode is made of annealed 1018 steel.

4. The ion source of claim 1, wherein at least the outer cathode is made of annealed 1018 steel.

5. An ion source comprising:

an anode, a cathode, a discharge gap defined proximate the anode and cathode;

a power supply in electrical communication with the anode and/or cathode;

at least one magnet capable of generating a magnetic field proximate the discharge gap; and wherein the anode and/or cathode comprises 1018 mild steel, wherein the outer cathode is segmented and comprises when viewed from above first and second spaced apart substantially rectangular portions and first and second substantially U-shaped portions, and wherein notches disposed at each end of each of the substantially rectangular portions engage notches defined in the substantially U-shaped portions so as to permit the substantially rectangular portions to fittingly engage the substantially U-shaped portions.

6. The ion source of claim 5, wherein at least part of the cathode comprises annealed 1018 mild steel.

7. An ion source comprising:

an anode, an inner cathode and an outer cathode, a discharge gap defined between the inner and outer cathodes;

a power supply in electrical communication with one or more of the anode, the inner cathode, and/or the outer cathode;

at least one magnet capable of generating a magnetic field proximate to the discharge gap; and wherein the outer cathode is segmented and comprises, when viewed from above: first and second spaced apart substantially rectangular portions, and first and second substantially U-shaped portions positioned between at least the first and second substantially rectangular portions, and wherein notches disposed at each end of each of the substantially rectangular portions engage notches defined in the substantially U-shaped portions so as to permit the substantially rectangular portions to fittingly engage the substantially U-shaped portions, and wherein the inner cathode and/or the outer cathode comprises annealed 1018 mild steel.

8. The ion source of claim 7, wherein the first and second spaced apart substantially rectangular portions, and the first and second substantially U-shaped portions, each comprise 1018 mild steel.

9. A method of making an ion source, the method comprising:

providing an anode, providing a plurality of pieces including first and second substantially rectangular portions and first and second substantially U-shaped portions, wherein the plurality of pieces comprise annealed 1018 steel for an outer cathode, and attaching the plurality of pieces comprising annealed 1018 steel together to form the outer cathode wherein notches disposed at each end of each of the substantially rectangular portions engage notches defined in the substantially U-shaped portions so as to permit the substantially rectangular portions to fittingly engage the substantially U-shaped portions;

providing an inner cathode;

assembling the anode, inner cathode and outer cathode in an ion source apparatus so as to form a discharge gap of the ion source defined between the inner and outer cathodes.

10. The method of claim 9, wherein the plurality of pieces comprising steel for the outer cathode include, in the outer cathode as assembled, first and second spaced apart substantially rectangular portions, and first and second substantially U-shaped portions positioned between at least the first and second substantially rectangular portions.

11. The method of claim 10, wherein the first and second spaced apart substantially rectangular portions, and the first and second substantially U-shaped portions, each comprise 1018 mild steel.

* * * * *